United States Patent [19]

Lambert

[11] 4,437,726

[45] Mar. 20, 1984

[54] FLEXIBLE PIN

[75] Inventor: Roger T. Lambert, Fridley, Minn.

[73] Assignee: Omnetics, Inc., Minneapolis, Minn.

[21] Appl. No.: 387,969

[22] Filed: Jun. 14, 1982

[51] Int. Cl.[3] ..... H01R 11/22

[52] U.S. Cl. ..... 339/252 P

[58] Field of Search ..... 339/252 R, 252 P

[56] References Cited

U.S. PATENT DOCUMENTS

| | | | |
|---|---|---|---|
| 538,423 | 4/1895 | Koenig et al. | 339/252 R |
| 2,517,677 | 8/1950 | Kjell-Berger et al. | 339/252 P |
| 3,008,118 | 11/1961 | Mavity | 339/217 |
| 3,098,687 | 7/1963 | Fitzgerald | 339/252 R X |
| 3,123,427 | 3/1964 | Yopp | 339/252 |
| 3,252,127 | 5/1966 | Woodward | 339/217 |
| 3,286,671 | 11/1966 | Fuller | 113/119 |
| 3,545,080 | 12/1970 | Evans | 29/629 |
| 3,581,272 | 5/1971 | Yopp et al. | 339/252 |
| 3,693,140 | 9/1972 | Nijman | 339/252 P |
| 3,697,931 | 10/1972 | Achten | 339/252 P X |
| 3,786,558 | 1/1974 | McCarthy | 29/630 |
| 3,808,588 | 4/1974 | McGregor | 339/217 |
| 3,924,921 | 12/1975 | Feightner | 339/252 |
| 4,168,878 | 9/1979 | Risser et al. | 339/217 |
| 4,169,654 | 10/1979 | Plyler et al. | 339/252 |

FOREIGN PATENT DOCUMENTS

| | | | |
|---|---|---|---|
| 1406969 | 6/1965 | France | 339/252 P |

*Primary Examiner*—William R. Briggs

*Attorney, Agent, or Firm*—Schroeder, Siegfried, Vidas & Arrett

[57] ABSTRACT

A flexible pin which is used with a tubular hollow member is disclosed herein. The flexible pin is made from a reel of beryllium copper integral parts having the blades or fingers extending from a barrel shaped member having each finger bent toward the other about a first radius and upon each finger being formed to the tangent of a second and shorter radius, conforming the fingers to the second radius until the tips of the fingers approach each other. The transverse projection of the fingers is greater than the barrel diameter.

12 Claims, 7 Drawing Figures

FLEXIBLE PIN

This invention relates to the field of electrical connectors and more particularly to the field of a flexible pin used in connection with a tubular receiving connector member.

DESCRIPTION OF THE PRIOR ART

The prior pin construction is such that the leaves or leaf members are first bent towards each other and then away from each other until reaching approximately one-half the length dimension of the leaf where they are again directed towards each other. With such a construction, the total contact area is generally the four corners of the most extended portion of the leaves. The most extended portion of the leaves are made so that they have an effective separation that includes a diameter smaller than the one piece stamped construction forming the barrel of the device.

For a further disclosure of a pin having both ends formed in a tubular member such as a barrel, reference may be had to U.S. Pat. No. 3,545,080 where the bowed portion does extend in a transverse direction and outwardly from the remainder of the pin.

U.S. Pat. No. 3,924,291 is directed to a pin having an end which folds back upon itself to give a contact under tension when inserted into a tubular member. This prior art disclosure also discloses a band or strap of metal that has all of the pin members connected to the same during the manufacturing process.

SUMMARY OF THE INVENTION

The flexible pin is made from a reel of beryllium copper having a thickness of 0.0045 inches of one-quarter (¼) hard temper and subsequently heat treated for greater strength. The blades of the pin have an upstanding portion where each leaf is 0.005 inches beyond the diameter of the barrel of the pin. That is, diameter of 0.200 inches which will allow for a minimum gap to be present between the rolled portions of the pin member. The pin member extends from its base with the leaves depressed about an inside curve of 0.322 inches radius, the leaves being separated by 0.004 inches. At the largest separation of the two leaves, a curvature of 0.181 inches is maintained as a radius. The above configuration permits the maximum separation of the leaves to be 0.0365 inches, as opposed from each other. Each of the edges has a coin edge having a radius of 0.0015-0.003 inches in which the coin edge area encompasses approximately 60 degrees of the corner section when measured from a vertical taken through the two leaves.

The width of the pin leaf is 0.016 inches plus or minus 0.0005 inches with the pin being reduced in width at the location of the first bend of the fingers where it is flexed the least and the width is 0.0125 inches. The overall length of the base and the pin is 0.308 inches, the pin being scored at the very edge of the base so that it may be broken from the reel of material.

It is therefore a general object of this invention to provide an improvement in flexible pins used with a tubular receiving connector member.

It is still another object of this invention to provide a flexible pin having a pair of confronting fingers with a transverse projection of the fingers engaging the tubular receiving connector member.

It is a further object of this invention to provide a flexible pin having a pair of confronting fingers having a reduced width allowing increased torsional flexibility and allowing increased axial misalignment between the axis of the flexible pin and the mating tubular member.

It is a more specific object of this invention to provide a flexible pin formed from sheet metal having a pair of confronting fingers extending from a barrel shaped first portion in which the tips of the fingers approach each other while they have their greatest transverse projection extended beyond the barrel diameter.

BRIEF DESCRIPTION OF THE DRAWINGS

A detailed description of one preferred embodiment of the flexible pin is hereafter described with specific reference being made to the drawings in which.

DETAILED DESCRIPTION OF INVENTION

Figure 2:
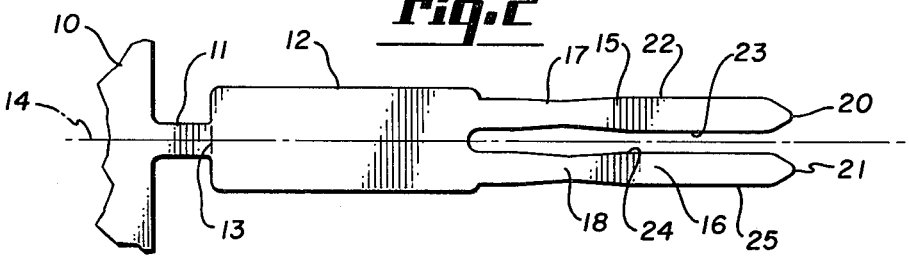
FIG. 2 is a side elevational view of an unformed flexible pin attached to a strip of material that is scored for breaking.

Turning to FIG. 2, there is shown a band of beryllium copper material 10 that includes a plurality of struts 11 to which is secured a first portion 12 that is rolled into a barrel shape 12A. A score line 13 is impressed in the material to approximately one-half the thickness to aid in breaking the strut 11 from barrel 12A. Extending parallel to a longitudinal axis 14 are a pair of fingers 15 and 16 that are cantilevered and integrally formed from the first portion 12. The overall length from the score line to the tip end of fingers 15 and 16 is 0.308 inches. Fingers 15 and 16 have reduced width portions 17 and 18 that appear 0.190 inches from the score line 13. The reduced width is located at a point of minimal bending stress allowing clearance between the edge of the fingers 15 and 16, and the interior of the mating tubular member, allowing increased accommodation of nonparallelism of the axis of the barrel and the mating tubular member. The tip ends 20 and 21 of fingers 15 and 16 are formed with a 0.005 inch radius where the remaining portion of the tip is formed with a 0.030 inch radius.

Figure 6:
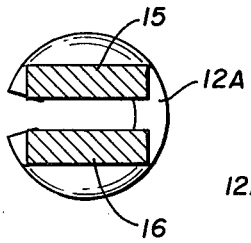
FIG. 6 is a sectional view of the fingers of said pin taken along lines 6—6 of FIG. 1.

Along the edge of each of fingers 15 and 16, extending from the reduced portion to the tip ends 20 and 21, are a pair of coined edges 22 and 23 on finger 15 and 23 and 24 on finger 16. As disclosed in FIG. 4, in the sectional view, the transverse projection of the fingers extend 0.005 inches beyond the edge of the diameter of barrel 12A and the separation between the two fingers or leaves is 0.004 inches as disclosed in FIG. 6.

Figure 3:
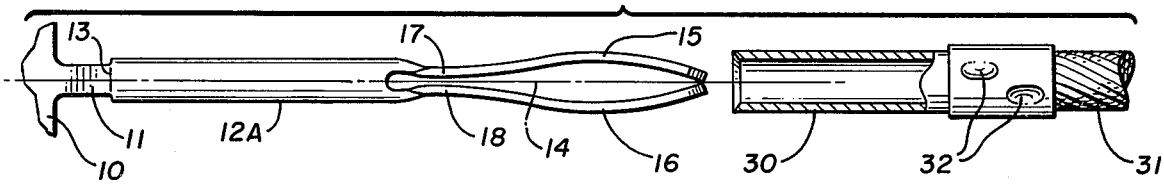
FIG. 3 is a side elevational view of a formed flexible pin and its mating receptacle used therewith.

The pin structure is formed to be inserted into a tubular receiving connector member 30 that has an inside diameter of 0.0225 inches and is shown broken away in FIG. 3. The connecting wire 31 is crimped at 32, to complete the connection for use with the flexible pin members. As the fingers are bent towards each other, the most desirable condition obtainable is that the tips of the fingers touch each other to give the greatest flexibility of fingers 15 and 16 and to assure the easiest insertion into the tubular receiving connector member 30.

Figure 1:
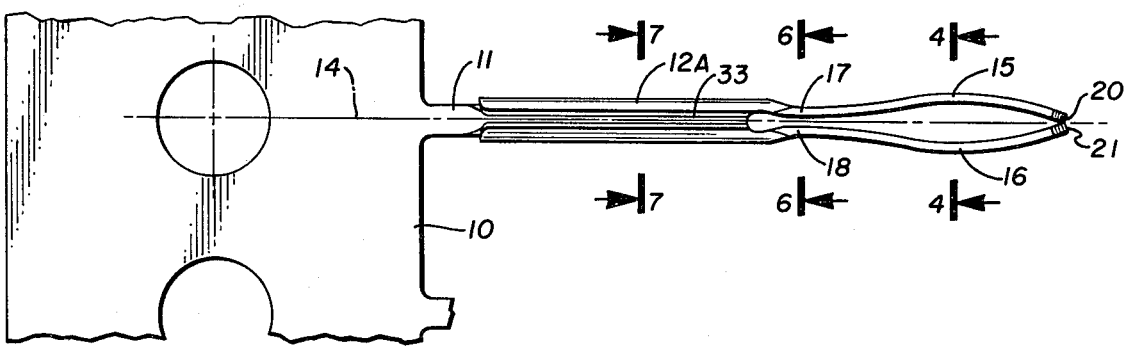
FIG. 1 is a side elevational view of a formed flexible pin of a plurality, attached to a strip of material used as a base for forming said pins.
Figure 4:
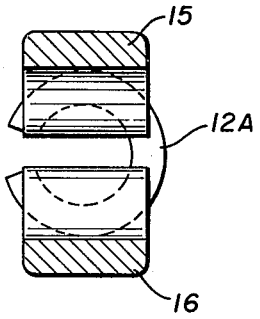
FIG. 4 is a sectional view of the fingers of said pin taken along lines 4—4 of FIG. 1.
Figure 5:
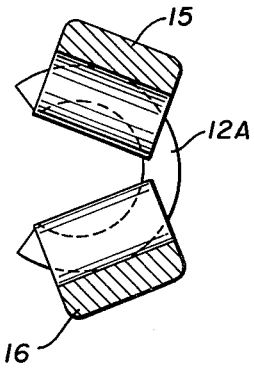
FIG. 5 is a sectional view of the fingers of said pin formed with a larger but usable diameter.
Figure 7:
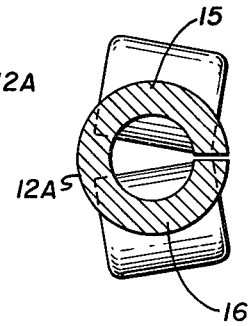
FIG. 7 is a sectional view of the pin barrel taken along lines 7—7 of FIG. 1.

When the fingers 15 and 16 (FIG. 2) are first formed in the structure seen in FIG. 1, barrel 12A may be curved until it assumes a circular cross section having a diameter of 0.215 inches such as disclosed in FIG. 4. In some applications of applying the pin to a printed circuit board, it may be desirable to have the pin with a larger radius such as disclosed in FIG. 5 where the barrel diameter is 0.0265 plus or minus 0.0005 inches. For some applications, the lateral edges of the first band 12 are curved towards each other to form a gap 33 with the two edges. In some applications, the minimum gap permits the diameter of barrel 12A to have a diameter of 0.020 inches and the fingers 15 and 16 assume the configuration disclosed in FIG. 7.

After the pin has been formed in the shape disclosed in FIGS. 1 and 3, the entire reel of pins is gold plated to produce the necessary electrical characteristics. The electrical characteristics of the pin are enhanced through the coined edges that have at least the corners which are formed in a typically smooth configuration to permit all four edges to contact the inner barrel of tubular receiving connector member 30 and produce a smooth wiping electrical contact which is also achieved through flexing of blades 15 and 16. That is, blades 15 and 16 maybe somewhat askew with each other and through the reduced width portions 17 and 18, the fingers are brought into what may be generally considered to be parallel alignment as shown in FIG. 4.

In forming the leaves or fingers 15 and 16, they are first bent towards each other about a radius that is substantially 1.77 times greater than the radius forming the largest lateral projection of leaves 15 and 16 such as found in FIG. 4. It will of course be recognized that the pins may take on various forms in being secured to a printed circuit board or may become a portion of a connector in which a plurality of the pins are secured side by side.

In considering this invention, it should be remembered that the present disclosure is illustrative only and the scope of the invention should be determined by the appended claims.

I claim:

1. For use with a tubular receiving connector member, a flexible pin used in conjunction therewith, comprising:

(a) an elongated sheet metal member having first and second portions defining a longitudinal axis;

(b) said first portion having a barrel shape in which the lateral edges thereof are bent towards each other with a gap formed therebetween;

(c) said second portion cantilevered integrally from said first portion and extending away from said first portion generally in the direction of said longitudinal axis, said second portion having a pair of fingers disposed in confronting relationship, one of which is the mirror image of the other, each finger being bent towards the other about a first radius and upon each finger being formed to the tangent of a second and shorter radius, conforming said finger to said second radius until the tips of said fingers approach each other, the greatest transverse projection of said fingers being greater than the barrel diameter.

2. The structure as set forth in claim 1 wherein the width of each finger is reduced between the commencement of said finger and the location of the greatest transverse projection of said fingers.

3. The structure as set forth in claim 1 wherein said first portion has a length that is substantially 95% of the length of said second portion.

4. The structure as set forth in claim 1 wherein the ratio of said second radius to said first radius is substantially 1.77.

5. The structure as set forth in claim 2 wherein the greatest transverse projection of each of said fingers exceeds the barrel diameter by at least 46 per cent.

6. The structure as set forth in claim 2 wherein the two outer edges of each finger constructed and arranged to contact the tubular receiving member has a coin edge.

7. The structure as set forth in claim 2 wherein a relieved semi-circular section of said first portion is formed joining each finger having a reduced width.

8. The structure as set forth in claim 2 wherein the reduced width of each finger is substantially 75 to 81 percent of the width of said finger.

9. The structure as set forth in claim 2 wherein the location of the greatest reduction to width of said finger allows increased torsional flexibility to permit better load distribution of said fingers when mating and corrects for non-parallelism between the longitudinal axes of said tubular receiving member and said barrel of the connector.

10. The structure as set forth in claim 2 including:

(d) another band of the same sheet metal material having a plurality of struts formed on the same extending laterally and outwardly therefrom, each of said first portion having a connection formed with each of said plurality of struts for securing the same thereto; and (d) scoring across the end of each of said plurality of struts to facilitate the breaking of said plurality of struts adjacent the barrel of said first portions.

11. The structure as set forth in claim 10 wherein each of the elongated sheet metal portions is made from quarter hard beryllium copper 0.0045 inches thick.

12. The structure as set forth in claim 6 wherein the coin edge has a radius of 0.0015 to 0.003 inches over each lateral edge for 60 degrees from a vertical plane through each finger.

* * * * *